US008991018B2

(12) United States Patent
Guthner

(10) Patent No.: US 8,991,018 B2
(45) Date of Patent: Mar. 31, 2015

(54) SHOELACE FASTENER SYSTEM

(71) Applicant: Alfred Guthner, Georgetown, TX (US)

(72) Inventor: Alfred Guthner, Georgetown, TX (US)

( * ) Notice: Subject to any disclaimer, the term of this patent is extended or adjusted under 35 U.S.C. 154(b) by 0 days.

(21) Appl. No.: 13/923,525

(22) Filed: Jun. 21, 2013

(65) Prior Publication Data

US 2014/0000074 A1 Jan. 2, 2014

Related U.S. Application Data

(60) Provisional application No. 61/665,655, filed on Jun. 28, 2012.

(51) Int. Cl.

| | |
|---|---|
| ***A43C 7/00*** | (2006.01) |
| ***A43B 3/00*** | (2006.01) |
| ***A43C 11/12*** | (2006.01) |

(52) U.S. Cl.

CPC ..... *A43C 7/00* (2013.01); *Y10T 24/3724* (2015.01); *A43B 3/0078* (2013.01); *A43C 11/12* (2013.01)

USPC ..... 24/712.9; 24/712.1

(58) Field of Classification Search

CPC ..... A43C 7/00; A43C 7/08; A43C 11/008; A43C 11/12; A43C 11/20; A43C 1/00; A43B 3/0078; Y10T 24/3724; Y10T 24/3713; Y10T 24/3703

USPC ..... 24/712.1, 712.5, 712.9, 712.2, 712.3, 24/712.7, 713, 713.2–713.4; 36/50.1

See application file for complete search history.

(56) References Cited

U.S. PATENT DOCUMENTS

| | | | | |
|---|---|---|---|---|
| 3,103,725 | A | 9/1963 | Robb et al. | |
| 4,733,439 | A | 3/1988 | Gentry | |
| 5,467,537 | A * | 11/1995 | Aveni et al. | 36/50.1 |
| 6,327,750 | B1 * | 12/2001 | Muldowney et al. | 24/68 SK |
| 6,718,602 | B1 | 4/2004 | Chang | |
| 7,124,482 | B2 | 10/2006 | Kim | |
| 7,658,020 | B1 | 2/2010 | Yun | |
| 2008/0083134 | A1 * | 4/2008 | Lin | 36/50.1 |

* cited by examiner

*Primary Examiner* — Robert J Sandy
*Assistant Examiner* — Abigail Morrell
(74) *Attorney, Agent, or Firm* — Daniel Boudwin; Global Intellectual Property Agency LLC

(57) ABSTRACT

A shoelace fastening system is provided having a first and second element that allow a user to tension shoelaces of a footwear article without tying the same, wherein the shoelaces remain in tension and are secured over the wearer's foot. The system includes a first member that is secured to the lowermost shoelace crossing at the throat line of the footwear article. This member is an arcuate structure that includes a plurality of apertures to accept the first crossing of the shoelaces, while also providing a location to secure the free ends of the shoelaces after being tensioned. A second, sliding member provides an apertured body member that accepts the shoelaces therethrough for tensioning the same over the footwear tongue. The sliding member secures the footwear to the wearer by operably applying tension to the shoelaces between the uppermost lacing eyelet and the arcuate member at throat of the footwear.

3 Claims, 4 Drawing Sheets

SHOELACE FASTENER SYSTEM

CROSS REFERENCE TO RELATED APPLICATION

This application claims the benefit of U.S. Provisional Application No. 61/665,655 filed on Jun. 28, 2012, entitled "XUTY." The above identified patent application is herein incorporated by reference in its entirety to provide continuity of disclosure.

BACKGROUND OF THE INVENTION

1. Field of the Invention

The present invention relates to shoe tie fasteners and devices for securing the laces of an article of footwear over a wearer's foot. More specifically, the present invention pertains to a shoelace fastening system comprising a shoelace arcuate member and a moveable, lace-cinching member that allow a wearer to secure and unsecure shoelaces without having to tie a knot.

There exist many types and styles of shoe fasteners for the purpose of retaining an article of footwear on a wearer's foot. The most common of these include shoelaces that can secure closed adjacent shoe quarters over the tongue region of the shoe article. Other common configurations include straps having an attachable end, shoe buckles, and affixable elastic members that secure the footwear article in a conformed fashion over the wearer's shoe. Shoelaces function by drawing together the shoe over the tongue portion, wherein the shoelace is weaved through shoelace eyelets (or equivalent members) and tensioned using a tied knot. While this is by far the most popular shoe securing method and one that is highly effective, the wearer is forced to physically tie a knot and untie the same knot when donning and removing the shoe, respectively, which can be burdensome for some.

While tying a shoelace into a knot is not a major chore for most, some have difficulty manipulating with the laces, while still others prefer an alternate method of securing their shoelaces together. Alternate methods of securing shoelaces together include different clasp structures and fastening members that improve efficiency of donning the shoe, while also offering an optional form of decoration to the shoe exterior. In any shoelace securing embodiment, is it desired to promote efficiency and to make it easy for the wearer to apply the shoelace device. The process of donning and removing the shoe must be facilitated, where the wearer is not enticed to leave his or her shoelaces untied or permanently affixed, wherein this is not desirable for safety or longevity of the shoe.

The present invention pertains to a new and novel shoelace securing system therefor. The system provides an alternate means of securing together shoelaces without knotting the same over a shoe tongue region. The system comprises a first and second fastening element attached to the shoelaces of an article of footwear, wherein the laces are woven through each device to tension the shoelaces and to secure the free ends of the shoelaces. A first arcuate member is positioned along the throat line of the footwear and accepts the first shoelace crossing. A second, slidable member is positioned along the shoe tongue and is used to tension the shoelaces, which then terminate within the arcuate member at the throat line. Overall, the system allows for a cleaner exterior look to a footwear article while also offering a means to securing and unsecuring shoelaces without tying or untying the same.

2. Description of the Prior Art

Devices have been disclosed in the prior art that relate to shoelace securing structures. These include devices that have been patented and published in patent application publications. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 7,658,020 to Yun discloses an eyestay ornament for an article of footwear secured closed by laces. The device comprises a marquee that is mounted between a pair of buckles. The buckles are adapted to receive shoelaces and support the eyestay ornament in connection with the laces of a wearer's shoe. The marquee can include two ornamental sides for flipping the device over and providing a different outward appearance for the shoe. While describing an article that interacts and secures with shoelaces, the Yun device is not adapted to help cinch tight shoe laces or take the place of traditional shoe lace tying techniques.

Another such device is U.S. Pat. No. 6,718,602 to Chang, which discloses a shoelace buckle for securing shoelaces in a taught configuration. The device comprises an arcuate main body having a hollow interior and an internal arrangement to accept laces therethrough and extend the laces out of the sides of the device. A cap covering is placed over the main body to secure the laces therein, whereby the laces can be pulled from the sides of the main body to tension the laces on the wearer's shoe. The Change device, while disclosing an arcuate body that accepts laces for tightening, describes a distinct structural arrangement from that of the present invention that is not contemplated herein.

U.S. Pat. No. 3,103,725 to Robb discloses a shoelace fastener that comprises a two-piece construction, wherein the fastener includes a channel-shaped plate portion and a wedge shaped member that is insertably engageable with the channel-shaped plate portion. The two members allow shoelaces to weave therethrough and then connect together to secure the wearer's shoelaces without physically tying the same. While providing a tie-less shoe securing system having two components, the Robb device includes a pair of structures that diverge in construction and function with respect to the present invention, which is related to a shoelace fastener having a portion secured along the footwear throat line and a second movable securing member along the tongue of the footwear article.

The present invention pertains to a shoe fastening system that includes a first and second member the function to tension the shoelaces of a shoe article and retain the free ends thereof. The system is both highly functional and offers a means of decoration or personalization of the shoe article. It is submitted that the present invention is substantially divergent in design elements from the prior art, and consequently it is clear that there is a need in the art for an improvement to existing shoelace securing structures. In this regard the instant invention substantially fulfills these needs.

SUMMARY OF THE INVENTION

In view of the foregoing disadvantages inherent in the known types of shoelace fasteners now present in the prior art, the present invention provides a new shoelace fastening system that can be utilized for providing convenience for the user when securing the shoelaces of a pair of shoes onto a wearer's foot without tying the laces.

It is therefore an object of the present invention to provide a new and improved shoelace fastener system that has all of the advantages of the prior art and none of the disadvantages.

It is another object of the present invention to provide a shoelace fastener system that offers a ready solution to any article of footwear having a shoelace configuration, whereby the user is provided an improved means of fastening the shoe without tying a knot in the laces.

Another object of the present invention is to provide a shoelace fastener system that reduces the time required to apply and secure an article of footwear to a wearer's foot.

Yet another object of the present invention is to provide a shoelace fastener system that includes an easy to use set of structures that secure the shoelaces of a footwear article without coming loose after being tensioned, whereby the user is not requiring to vigilant over the application of the present fastening system after tensioning the shoelaces.

Another object of the present invention is to provide a shoelace fastener system that can offer a form of decoration to an article of footwear, wherein the device is both functional and decorative in nature.

Another object of the present invention is to provide a shoelace fastener system that eliminates the tripping hazard of loose shoelaces ends, which can otherwise tangle with the wearer's opposite foot if not secured and overly exposed.

A final object of the present invention is to provide a shoelace fastener system that may be readily fabricated from materials that permit relative economy and that are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
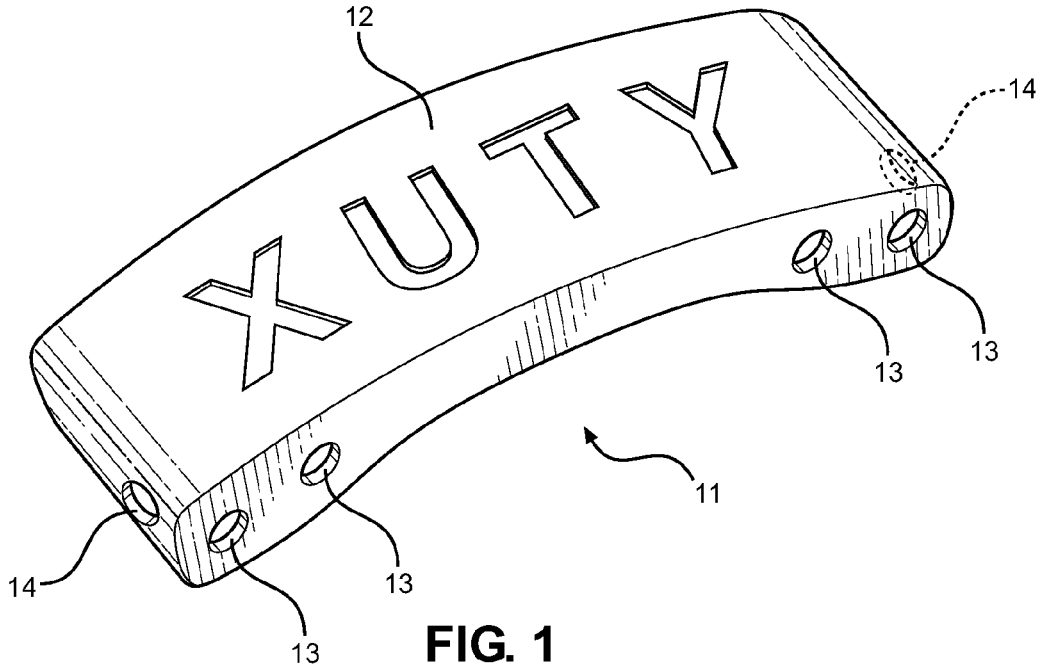
FIG. 1 shows a perspective view of the lowermost, arcuate member of the present invention that secures to the base of the shoelaces and secures the free ends thereof.

Reference is made herein to the attached drawings. Like reference numerals are used throughout the drawings to depict like or similar elements of the shoelace fastening system. For the purposes of presenting a brief and clear description of the present invention, the preferred embodiment will be discussed as used for securing the shoelaces of an article of footwear without tying a knot. The figures are intended for representative purposes only and should not be considered to be limiting in any respect.

Figure 2:
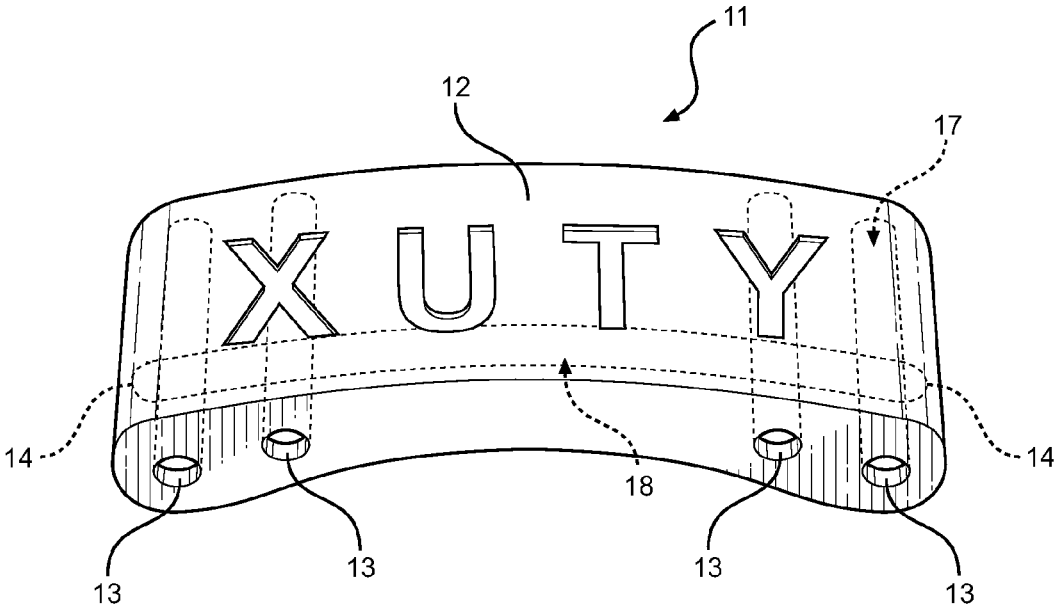
FIG. 2 shows another perspective view of the arcuate member, along with the apertures therethrough.

Referring now to FIGS. 1 and 2, there is shown a perspective view of the first member 11 of the shoelace fastening system of the present invention. The first member 11 comprises an arcuate structure that is adapted for placement across the throat line of a shoe where the shoelace makes its first crossing over the tongue of the shoe. The member 11 includes several apertures 13, 14 to accept a shoelace therethrough. A pair of side apertures 14 is located along the sides of the member 11 and connect an elongated channel 18 through the body of the member 11. This channel 18 extends lengthwise across the member 11 and is adapted to accept the lowermost shoelace crossing therethrough. In this way, the first member 11 secures to the shoelace along the throat of the shoe and is positioned over the tongue at the base of the laces.

The positioning of the first member 11 is such that it can be readily seen when secured to the footwear article. The primary purpose of the member 11 is to provide a means to secure the free ends of the shoelace thereto while allowing a second member to tension the shoelace therefrom. The upper surface 12 of the member 11, however, may comprise a decorative finish or stylish appearance, providing a decorative item for the shoe as well as a functional element. Outer decorative finishes may include different indicia, such as trademark names and proper names, or ornamental attachments such as birthstones and the like. The member 11 is preferably arcuate in shape, however it can also be fashioned in different shapes and have different outward styles to suit the user and to match the footwear article.

Once applied to the throat of the shoe and secured by the shoelace in its first crossing, the first member 11 is in a working position and ready to accept the free ends of the shoelaces therein. The shoelaces are woven through the eyelets of the shoe and across the shoe tongue as would normally be provided. Once woven over the tongue, however, rather than applying a knot to the shoelace ends, the ends are fed through a second, sliding member (see FIGS. 3 and 4) that acts as a cinching element. The free ends are then placed through shoelace end apertures 13 in the first member 11 to secure the lace ends therein. The lace ends are placed through apertures 13 along the upper portion of the first member 11 and then doubled back and placed through a pair of adjacent apertures 13 along the lower portion of the first member 11. The apertures 13 provide ready placement of the shoelace through a first and second pair of widthwise channels 17 that are adapted to secure the ends of the shoelaces therein. In this way, the laces are secured thereto such that the sliding member can tension the laces according to the wearer's preferences.

Figure 3:
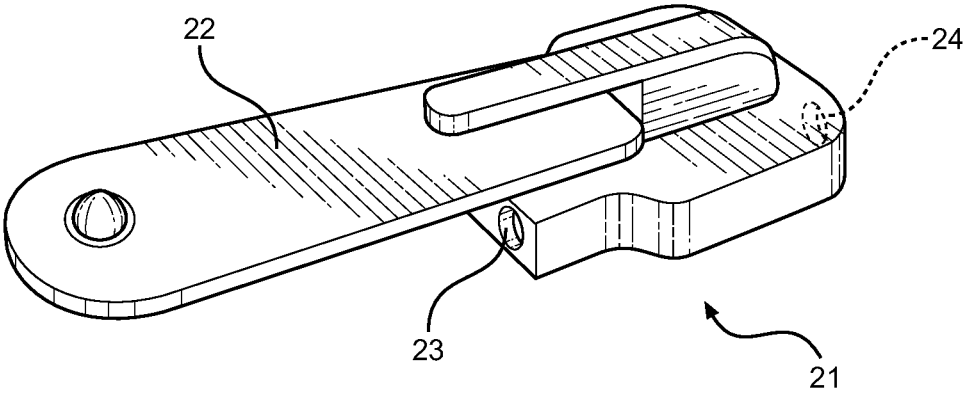
FIG. 3 shows an exemplary embodiment of the sliding member that accepts the shoelaces therethrough and tensions the same over the shoe tongue.
Figure 4:
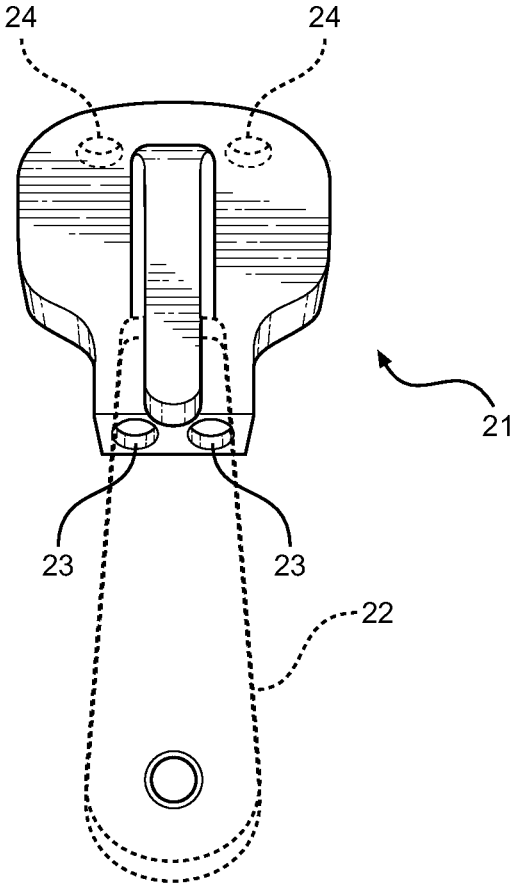
FIG. 4 shows another view of the sliding member and the shoelace apertures therethrough.

Referring now to FIGS. 3 and 4, there is shown views of the second, sliding member 21 of the shoelace fastening system of the present invention. The second member 21 comprises a body structure that accepts through the two free ends of the footwear shoelaces and is adapted to be placed over the tongue of the shoe. The member 21 slides along the laces between the uppermost eyelet and the first member of the present invention to tension the shoelaces against the tongue of the shoe and the foot of the wearer. This tensioning secures the quarters of the shoe together, wherein the sliding member 21 takes the place of a shoelace knot.

A first and second shoelace channel is provided on the sliding member 21, wherein uppermost apertures 24 accept through the shoelaces ends and a set of lowermost apertures 23 allow the shoelace ends to be pulled therethrough. The ends are then secured to the fastening system first member, whereafter the sliding member 21 acts to draw the laces together towards the shoe opening, thereby tensioning the laces and closing the shoe opening around the wearer's ankle to secure the shoe thereto. To accomplish the sliding, a pull handle 22 is provided on the sliding member 21, which allows the structure to slide along the laces and draw them together for securing and unsecuring the shoe to the wearer.

Figure 5:
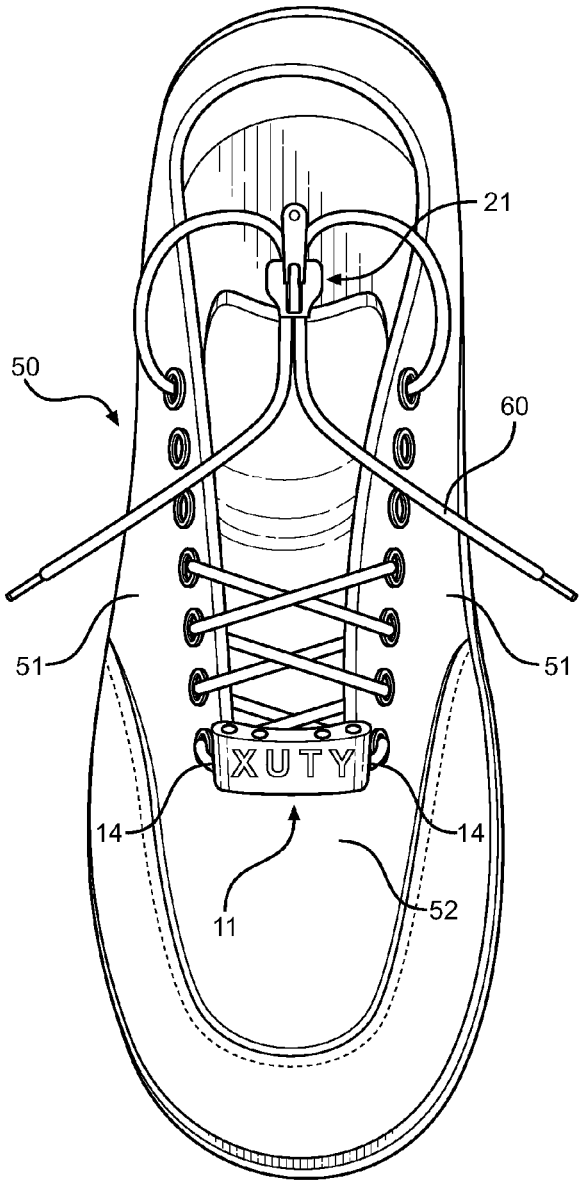
FIG. 5 shows the present invention being deployed on a sneaker.
Figure 6:
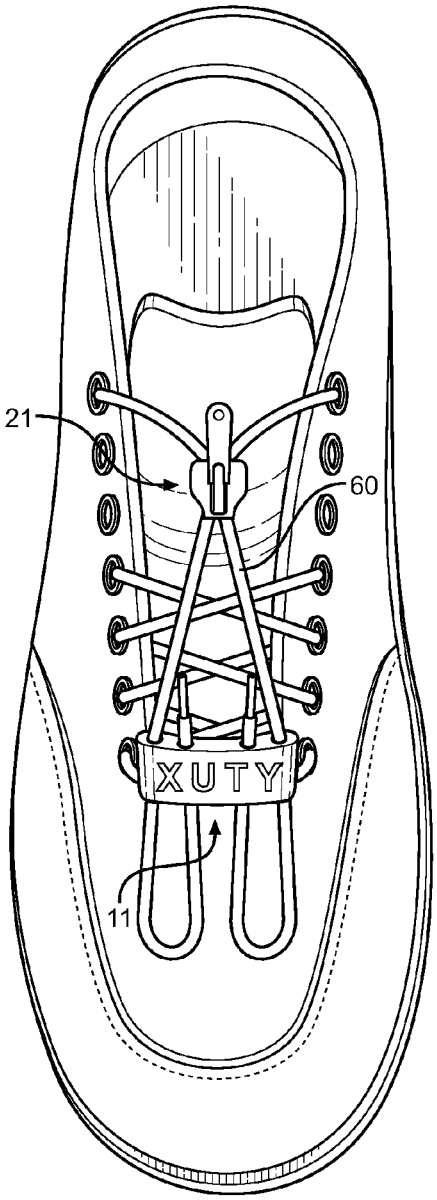
FIG. 6 shows the present invention securing the ends of shoelaces on a sneaker.

Referring now to FIGS. 5 and 6, there is shown overhead views of the shoelace fastening system of the present invention in use on a sneaker 50 article of footwear. The first step to applying the system is to secure the lowermost, first member 11 to the base of the tongue (throat line) 52 by way of the first shoelace crossing. The shoelace 60 is woven through the side apertures 14 of the first member 11 and then woven across the tongue of the shoe using the eyelets supported by the shoe quarters 51. The shoelace ends, once woven to the highest eyelet desired by the wearer, are then placed through the body of the second, sliding member 21 of the present invention.

Once the sliding member 21 has been engaged, the shoelace ends are fed through the apertures of the first member 11. The ends are fed through once and then doubled back to secure the ends thereto. Once secured, the sliding member 21 can be utilized to tension the laces 60 once the wearer's foot is placed into the shoe. The system allows a user to readily open and secure the shoe 50 without tying the laces, and to readily slip the shoe 60 onto his or her foot by simply spreading the opening of the shoe and sliding downward the sliding member 21.

Figure 7:
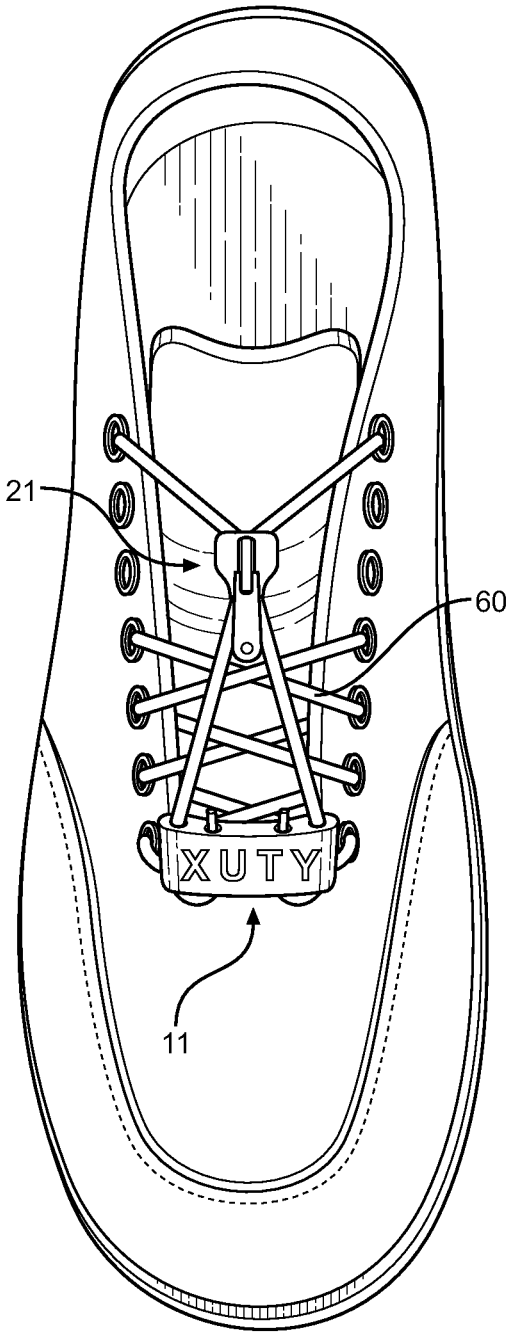
FIG. 7 shows a view of the present invention after being applied to a sneaker, wherein the sliding member is tensioning the shoelaces to secure fitment of the sneaker to the wearer.

Referring now to FIG. 7, there is shown a view of the fastening system of the present invention in a working state, securing the laces 60 of a shoe in a secure and tensioned configuration for the wearer to walk or run in the shoe without fear of the laces coming loose or the free ends thereof becoming a trip hazard. The sliding member 21 comprises a pair of channels that are adapted to prevent free sliding when the lace incoming and outgoing angle is not aligned with the channel direction. This prevents the sliding member 21 from freely sliding along the laces and thus prevents the laces from becoming loose without direct interaction by the wearer. The wearer can pinch the laces together about the sliding member 21 to allow for smooth sliding, whereafter the laces spread apart and the sliding member locks into a static position therealong. The tension is therefore maintained in the shoelaces between the sliding member 21 and the first member 11 during deployment.

The first and second channels of the sliding member are further designed to be of narrow cross sectional area or diameter, such that shoelaces do not readily slide in and out of the channels without assistance from the wearer pulling on the pull handle 22 thereof. This, along with the inherent angle of the laces entering and exiting the sliding member 21 apertures prevents free sliding thereof and thus maintains the sliding member 21 position while in operation.

Many people have a difficult time keeping their shoelaces tied together in a knot and their footwear adequately secured. They may find themselves constantly having to retie their shoes to prevent loosening of the laces and tripping over the loose free ends thereof. This may be especially true with children, who may not be able to tie their shoestrings properly in the first place. Many business professionals tie their shoes and then tuck the strings into their shoes for a neater appearance. This look, however, may still leave the shoe looking big and bulky, and does not prevent the knot from becoming loosened over time.

The present invention describes a shoelace fastening system. The device comprises a sliding member and a static, lowermost member that allow a shoelace to be passed therethrough for tensioning the shoelace therebetween. The sliding member attaches along the shoe upper and above the tongue to prevent the wearer from having to hand tie the shoelaces. This provides the wearer with a convenient way to prevent his or her shoestrings from untying and getting in the way.

Along with functionality, may people enjoy customizing their footwear. The present invention provides not only a functional securing system, but an assembly that can support a variety of ornamental designs and shapes. The device is ideal for those looking to secure their shoes, those looking to customize their shoe appearance, and also those that prefer a neater outward appearance to their shoelace-secured footwear.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shoelace fastening system, comprising:

a first member comprising a body structure having a lengthwise channel, and a first and second pair of widthwise channels;

said lengthwise channel and said widthwise channels being substantially perpendicular to one another and said lengthwise channel substantially overlapping said widthwise channels;

said first member adapted to be secured by a shoelace crossing a shoe tongue, wherein said first member lengthwise channel supports said shoelace crossing;

said widthwise channels adapted to support shoelace ends;

a sliding member comprising a body structure having a first and second shoelace channel therethrough and a sliding member pull handle;

said first and second shoelace channel sized to accept shoelaces therethrough and draw said shoelaces together;

said first and second shoelace channel of said sliding member each having a cross sectional area that is configured to prevent free sliding of a shoelace therethrough.

2. The shoelace fastening system of claim 1, wherein said first member body structure further comprises an upper surface having an ornamental structure thereon.

3. The shoelace fastening system of claim 1, wherein said first member body structure further comprises an arcuate shape.

* * * * *